United States Patent [19]

Tiletschke et al.

[11] 4,325,533

[45] Apr. 20, 1982

[54] HOUSING DEVICE FOR ISOLATING CONNECTING REINFORCEMENTS AT JOINTS BETWEEN FIRST AND SUBSEQUENTLY POURED CONCRETE STRUCTURES

[75] Inventors: Lothar Tiletschke; Hellmuth Feldmann, both of Bielefeld, Fed. Rep. of Germany

[73] Assignee: Sigma Bauelemente GmbH, Bielefeld, Fed. Rep. of Germany

[21] Appl. No.: 178,618

[22] Filed: Aug. 15, 1980

[30] Foreign Application Priority Data

Aug. 23, 1979 [DE] Fed. Rep. of Germany ..... 2934189

[51] Int. Cl.[3] ..... E04C 1/00; E04B 1/41

[52] U.S. Cl. ..... 249/188; 52/378

[58] Field of Search ..... 52/606, 414, 378, 699, 52/98, 710, 706, 576, 577; 249/18, 19, 83, 84, 188, 190

[56] References Cited

U.S. PATENT DOCUMENTS

| | | | |
|---|---|---|---|
| 703,644 | 7/1902 | Davies | 52/606 |
| 4,010,586 | 3/1977 | Brechbuhler | 52/378 |

FOREIGN PATENT DOCUMENTS

| | | | |
|---|---|---|---|
| 1177308 | 9/1964 | Fed. Rep. of Germany . | |
| 2142140 | 1/1973 | France . | |
| 1297160 | 11/1972 | United Kingdom . | |
| 2051917 | 1/1981 | United Kingdom | 52/699 |

*Primary Examiner*—John E. Murtagh
*Assistant Examiner*—Eugene R. Washington
*Attorney, Agent, or Firm*—Murray & Whisenhunt

[57] ABSTRACT

The invention provides a device for housing steel reinforcement in areas where joints are made between first and subsequently poured concrete structures such that connecting portions of the steel reinforcements are isolated during pouring of the first concrete and are thereafter bent out for connecting the subsequently poured concrete structure. The device comprises a housing having an open box, a cover therefore, and anchoring strips disposed in the transverse direction of the box at intervals along its length and at the bottom thereof. The anchoring strips having transverse slots in the upper portion thereof to receive and support the connecting portions of the steel reinforcements. The cover is capable of being locked to the box and capable of passing the anchoring portions therethrough.

16 Claims, 8 Drawing Figures

FIG.5
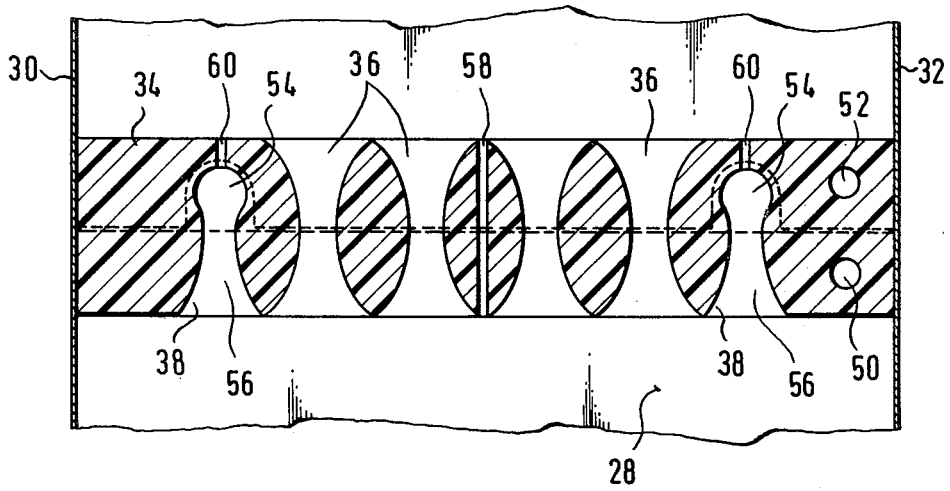
FIG.6
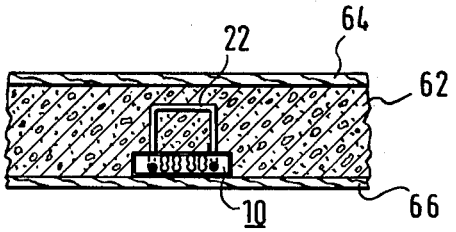
FIG.8
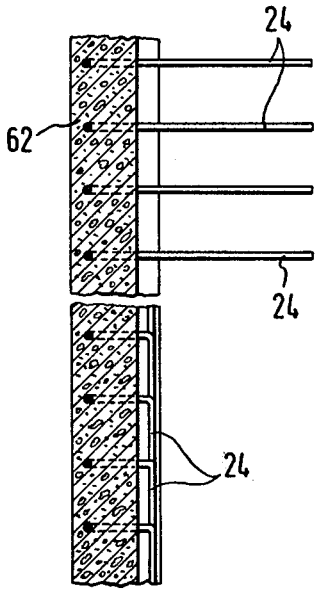
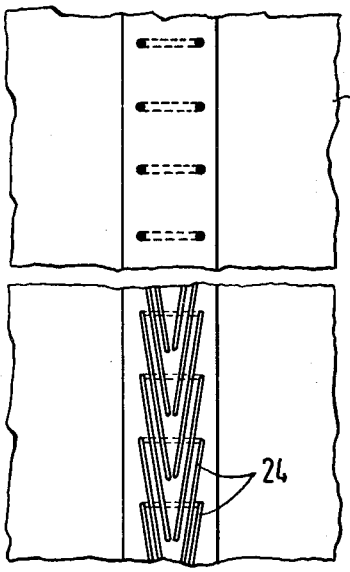
FIG.7

HOUSING DEVICE FOR ISOLATING CONNECTING REINFORCEMENTS AT JOINTS BETWEEN FIRST AND SUBSEQUENTLY POURED CONCRETE STRUCTURES

The present invention is concerned with an apparatus for isolating steel reinforcements in areas where joints are made in poured concrete structures. The apparatus, generally, is in the form of an elongated, essentially box-shaped housing, in which portions of the steel reinforcements, which are to connect a previously poured concrete section with a subsequently poured concrete section are isolated from the concrete of the first poured section. The isolated reinforcements are bent out from the first poured section in which the reinforcements are embedded. The bent out portions become anchoring portions for the subsequently poured sections.

BACKGROUND OF THE INVENTION

Devices of the present nature have been known, e.g. as disclosed in German DE-AS No. 25 03 742. In these known devices, the connecting steel reinforcements are isolated in a housing device which is constructed as a box shaped structure of foam plastic. When a joint area, for example, a T-shaped butt joint between a previously poured concrete wall and a subsequently poured concrete wall, at a right angle thereto is to be prepared, after the known housing device has been integrally cast into the previously poured concrete wall it is necessary to remove the foam plastic in order to bend the connecting portions of the steel reinforcements outwardly for attachment to the subsequently poured wall. In particular, the steel reinforcements themselves must be completely free of foam plastic, since an inadequate joining of steel and concrete will result if that is not done. This requires a considerable amount of work, since the foam plastic is held firmly by the steel reinforcements and can only be scraped out in small pieces.

OBJECTS OF THE INVENTION

Therefore a basic object of the invention is to provide a housing device of the aforementioned type which can be removed easily and with a slight expenditure of time, after being integrally cast into a concrete structure.

BRIEF DESCRIPTION OF THE INVENTION

The foregoing object is accomplished by the invention with a housing device embodying the general concept of disposing within an opened box anchoring strips which are placed at intervals on the bottom of the box and along the length of the box and disposed transversely to the longitudinal axis of the box. The anchoring strips have slots in the upper area thereof for holding connecting portions of the steel reinforcements, which are essentially at right angles to their longitudinal axis. The box is capable of being closed by a cover which will receive and pass the anchoring portions therethrough.

Thus, the housing device is constructed as an open box capable of being closed by a cover structure. After casting into a poured concrete section, the box can be withdrawn from the concrete in one manipulation, leaving part of the reinforcements cast into the concrete and part for anchoring a subsequently poured concrete section. Another advantage is that the box, as such, can be manufactured for receiving various steel reinforcement bars or can be manufactured and used by others who load the steel reinforcements into the box and, thus, supply the loaded boxes to the builder as a unit. Putting the reinforcements in the box is a simple and clean process and after removing the box from the cast concrete section, no removing of foam from the housing is necessary.

Since the anchoring portions of the steel reinforcements protrude from the housing device, it is preferable to arrange the areas of the box cover for receiving and passing the steel reinforcements to be on the lines separating each pair of adjoining cover elements. The cover elements can have corresponding recesses (apertures) in the edges thereof which are next to each other to receive and pass the steel reinforcements.

Preferably, the slots in the anchoring strips, which are located opposite each other and at both ends of the anchoring strips, are made as "blind" slots, which can only be entered from one side, so that they can receive the bent, projecting anchoring portions of the steel reinforcements and support them. In this case, it is advantageous for the cooperating pairs of cover elements to be located on the longitudinal center line of the anchoring strips.

The other slots in the central area of the anchoring strips preferably have an X-shaped cross section and extend on both sides from a narrower central area, so that the connecting portions of the steel reinforcements, which are later bent out, can be installed crosswise at an acute angle to the longitudinal axis of the strips.

Since the steel reinforcements must be held firmly in the slots of the anchoring strips, it is advantageous to make the slits with back tapers, which, for example, when viewed in vertical section, are generally, in the shape of an "8". By this arrangement two steel reinforcements may lie one above the other and both can be held securely with a clamping action.

Since the construction with anchoring strips, and especially with the steel reinforcements clamped therein, is relatively sturdy, the box bottom of the housing and the cover elements of the housing can be made of relatively thin material, e.g. in the form of foils or plates. The anchoring strips preferably are cemented to the bottom and the side walls of the bottom box.

BRIEF DESCRIPTION OF THE DRAWINGS

Preferred embodiments of the invention are described in greater detail hereafter with reference to the drawings.

FIG. 5 is a partial plan view of anchoring strips shown in FIG. 1.

FIG. 6 through 8 illustrate the use of a housing device in accordance with the invention.

DETAILED DESCRIPTION OF THE INVENTION

Figure 1:
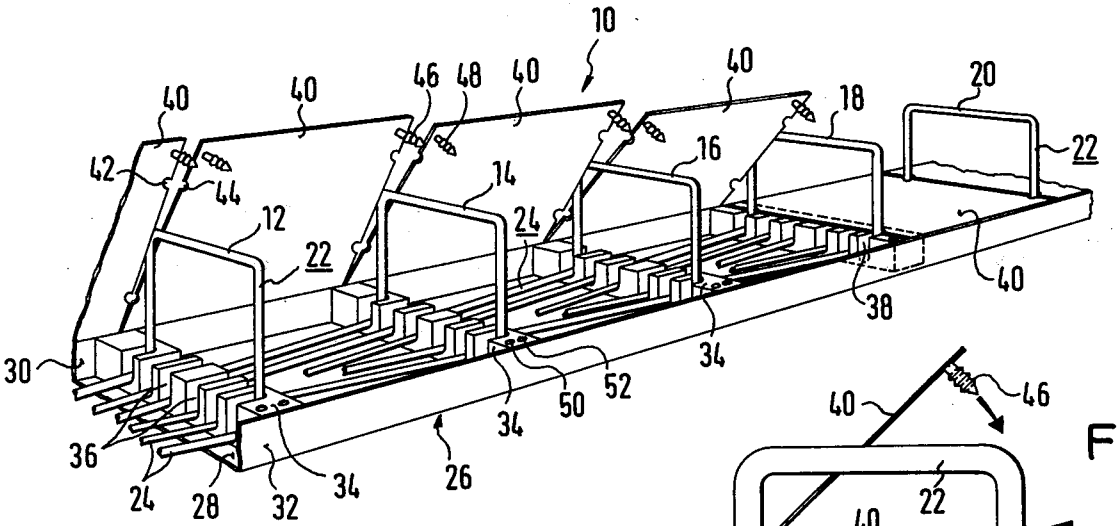
FIG. 1 shows the entire housing device of the invention in perspective.

A housing device which is shown in FIG. 1 and which, taken as a whole, is indicated by the reference number 10, receives steel reinforcements 12, 14, 16, 18, 20. The reinforcements, taken as a whole, are generally in a U-shaped loop but with portions being bent at right angles to the plane surface of the loop in the vicinity of their closed ends. Such steel reinforcements are used to connect parts of structure made of concrete which are poured in two successive steps. In making the first of these concrete structural parts, the closed housing device 10 is laid with the surface which is at the bottom of FIG. 1 against the pouring form, so that the portions of the steel reinforcements 12, 14, 16, 18, 20 projecting out of the device 10 (which are designated as anchoring portions 22) also project into the inner space of the pouring form and are anchored in the poured concrete mass.

After the form (not shown) is removed, the housing device is taken out of the hardened concrete, and the portions of the steel reinforcements, which are laying flat in the housing 10 (designated connecting portions 24) are bent out from the hardened concrete to form right angles thereto. These connecting portions 24 are integrated into the formwork of the subsequently poured concrete part, so that a reinforced joint between the two concrete parts results. More detailed information on using the device of the invention will be proved hereinafter in combination with FIGS. 6 through 8.

The housing device 10 includes a flat box 26, having a bottom 28, side walls 30 and 32 and front walls, which are not shown. On the inside of the box 26 and at right angles to its longitudinal axis are a series of anchoring strips 34, disposed parallel to each other and spaced at intervals from each other. These strips 34 have slots 36 which enter from above and run at right angles to the longitudinal axis of the anchoring strips. Slots 36 are located in the longitudinal central area of the anchoring strips 34. In addition, strip 34 has slots 38 provided at the ends of the anchoring strips and which slots 38 only enter the anchoring strip from one side and from above, thus forming "blind slots." While the elongated straight connecting portions 24 of the steel reinforcements 12, 14, 16, 18, 20 are in the slots 36, provided in the central area of the anchoring strips, the outer slots 38 accommodate the bent portions between the connecting portions 24 and the anchoring portions 22 of the steel reinforcements. The anchoring portions 22 project from the slots 38 at right angles to the housing device 10 and emerge from the top of it.

The box 26 is closed by a cover, e.g. a number of cover elements 40 which are separated from each other along the longitudinal center lines of the anchoring strips 34. Each anchoring portion 22 of the steel reinforcements can project from the housing device between two cover elements 40. As can be seen from FIG. 1, there are semicircular apertures (recesses) 42, 44 in the edges of the cover elements 40 which adjoin each other, and they combine to form circles which enable them to receive and pass the anchoring portions 22. Therefore, the box 26 is capable of being tightly closed by the cover elements 40.

Figure 2:
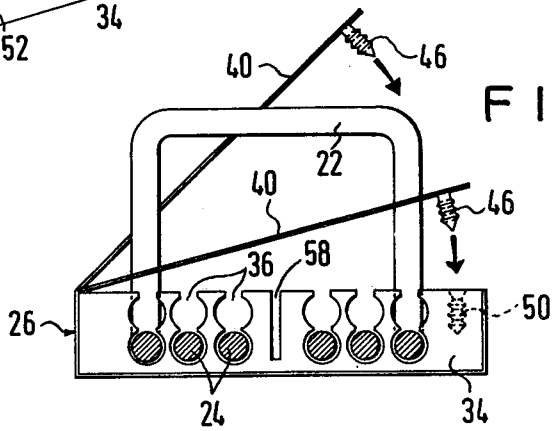
FIG. 2 shows a cross section through the device of FIG. 1.

Furthermore, as can be seen from FIGS. 1 and 2, locking pins 46, 48 are provided on the underside of the cover elements 40 which are capable of engaging corresponding anchoring holes 50, 52 in the anchoring strips 34 and hold the cover elements 40 in the closed position.

Figure 3:
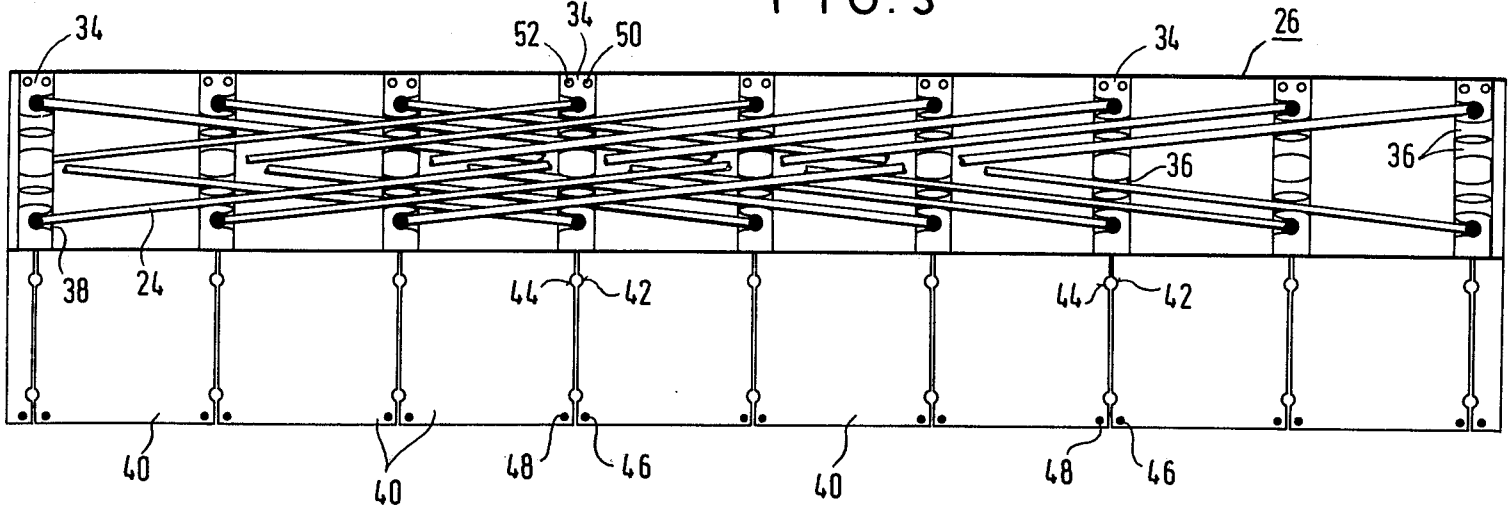
FIG. 3 is a plan view of the device of FIG. 1 in the opened configuration.

In FIG. 3, the connecting portions 24 of the steel reinforcements in the slots 36 of the anchoring strips 34 are arranged so that they run at an acute angle to the longitudinal axis of box 26, so that the steel reinforcements can be brought into relatively close succession without interfering with each other inside the housing device. In order that the connecting portions 24 can be installed crosswise in slots 36, the slots 36 are sufficiently deep so that they may receive two connecting portions 24, one above the other, as can be seen in FIG. 2, for example. In order that the anchoring portions 22 of the steel reinforcements can be arranged crosswise, the slots 36 preferably have an X-shaped cross section, as can be seen from FIGS. 3 and 4, which extends on both sides from the central area.

The outer slots 38, which serve the purpose of receiving the bent connecting parts between the connecting portions 24, and the anchoring portions 22, can include and undercut, inner locking portion 54 and a funnel-shaped, expanded opening areas 56 in horizontal cross section (see FIG. 3). The locking portion 54 brings about a firm clamping of the projecting arm of the anchoring portion 22. The funnel-shaped opening areas 56 make possible a withdrawal of the connecting portions 24 at an acute angle to the longitudinal center line of the box 26.

In order to clamp the connecting portions 24 of the steel reinforcements firmly, the slots 36 and 38 also have undercuts in vertical cross section, as can be seen in FIG. 2, so that a FIG. "8", in cross section, results, approximately as shown in FIG. 2, when two connecting portions 24 are installed one above the other.

Dividing slits 58, 60 are also indicated in FIGS. 2 and 5 which enter the anchoring strips 34 from above and at right angles to them and permit a certain flexible forming of the parts of the anchoring strips 34 which work as clamping jaws.

The anchoring strips 34 can be made of flexible plastic, and the slots 36, 38 can be so dimensioned in relation to the dimensions of the steel reinforcements that the latter must be forced into the slots with a certain amount of pressure and thus held by these clamps.

Figure 4:
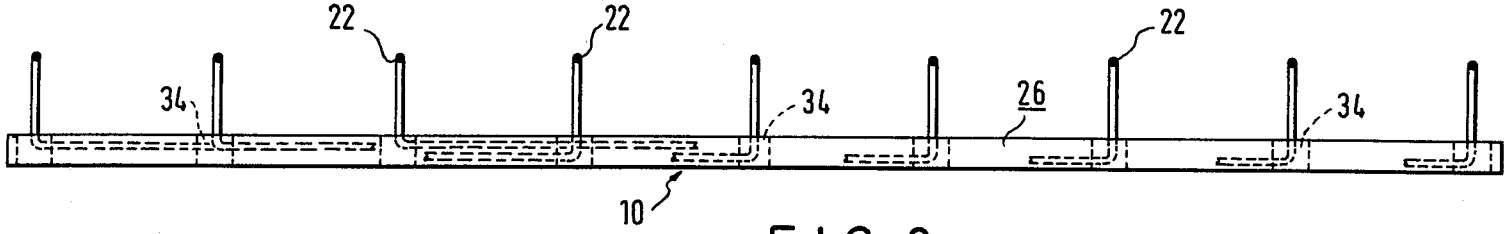
FIG. 4 is a longitudinal section through the closed housing device of FIG. 1.

FIG. 4 shows a side view of the device 10 with anchoring portions 22 of the steel reinforcements projecting out of it. It can be seen that the connecting portions of the steel reinforcements, which are not indicated specifically there, lie in the box 26 in two layers, one above the other.

The employment of the device of the invention will now be described in detail with reference to FIGS. 6 through 8. A T-shaped butt joint between two concrete walls which are poured in two successive steps will serve as an example. One of the concrete walls is poured first; it is designated as 62. During the pouring, the device 10 of the invention, positioned vertically, is located inside a form designated 64, 66, with the bottom surface of the device against one of the forms 66. In that position, the anchoring portions 22 of the steel reinforcements project into the concrete matrix, so that they are anchored in the poured concrete wall 62.

After the form 66 is removed, the bottom 28 of the device 10 is accessible from the outside. Since the anchoring strips 34,, with the respective slots 36, 38, only grasp the steel reinforcements from underneath, the entire housing device can be removed from the cast integral anchoring portions 22 and the connecting portions 24 with one manipulation, for the most part. Then the connecting portions 24 are bent vertically out from the concrete wall 62 in the usual manner, as can be seen in the upper parts of FIGS. 7 and 8. After an appropriate form has been made the next concrete wall can be poured and will be anchored to the bent out portions 24.

Since the connecting portions 24 lie inside the device 10, and consequently inside the form 66 during the pouring of the first concrete wall 62, as shown in the lower part of FIG. 8, it is not necessary to destroy the form 66 by the usual drilling of holes therein, and the form may be reused. It was pointed out earlier that the bottom box 26 and the cover elements 40 can be made of thin, foil-like plastic material or cardboard, since the arrangement of the anchoring strips 34 and the steel reinforcements clamped therein constitutes a structure which is sufficiently capable of bearing weight.

Within the framework of the embodiment which was discussed earlier, anchoring strips 34 were described as relatively massive strips with slots, or grooves. However, such is not necessary, and the strips may, instead, be made of wire, steel strips, or similar materials. These will, of course, have contours which form the slots, etc. and thus will receive the steel reinforcements. Strips made in this manner, nevertheless, are not massive but adequately perform the function intended. Thus, it is only necessary that some locking means, in the nature of the strips 34, be disposed at right angles to the longitudinal axis of the bottom box, since it is necessary to clamp the steel reinforcements in the box, keep them at certain intervals from each other and in the desired position.

The cover 40 also permits various modifications. It is only essential that the cover allow for the emerging anchoring portions of the steel reinforcements to pass through. The cover may be a complete unit with slots and/or cutaway portions to receive the anchoring portions, or in the form of individual elements. It can also be hingedly connected to an upper, free, longitudinal edge of the bottom box 26, as is the case in the example which has been described. Also the construction of the cover does not have to conform to the exact shape of the anchoring portions. These anchoring portions need not have the "U" shape, as earlier described, but can have any bent shape for anchoring. Neither do they have to be in the shape of a loop.

Other locking elements or locking procedures can be used instead of the locking pins which were described. In the case where a plastic foil is used to produce the box, the cover can be sealed by spot welding. Adhesive tape, Velcro strips or similar devices can also be used to secure the cover.

Having described the invention, it will be apparent to those skilled in the art that the above and similar modifications may be used. Hence, such modifications are intended to be embraced by the spirit and scope of the following claims.

We claim:

1. In a device for housing steel reinforcements in areas where joints are made between first and subsequently poured concrete structures and having an elongated, essentially box-shaped for isolating connecting portions of the steel reinforcements having anchoring portions during pouring of the first concrete structure, the improvement comprising a housing having an open box, a cover therefore, and anchoring strips disposed in the transverse direction of the box at intervals along its length and at the bottom thereof, said anchoring strips having transverse slots in the upper portion thereof to receive and support the connecting portions of the steel reinforcements, and said cover being capable of being locked to said box and passing the anchoring portions therethrough.

2. The device as claimed in claim 1, wherein the cover is divided into individual cover elements along the center lines of the anchoring strips.

3. The device as claimed in claim 2, wherein the cover elements are hingedly attached to a longitudinal edge of the box.

4. The device as claimed in claim 1 or claim 2 or claim 3 wherein the box and the cover are of foil-like or plate-like plastic material or cardboard.

5. The device as claimed in claim 1 or claim 2 or claim 3 wherein the anchoring strips are constructed as essentially solid pieces of plastic.

6. The device as claimed in claim 1 or claim 2 or claim 3 wherein the anchoring strips are made of wire or spring steel which is bent to conform with the contours of the slots.

7. The device as claimed in claim 1, wherein the slots provided at outer opposite ends of the anchoring strips are blind slots which enter at one side of the strips.

8. The device as claimed in claim 7, wherein the slots lying between the outer blind slots are essentially in an X-shape in horizontal cross section of the strips.

9. The device as claimed in claim 1 or claim 2 or claim 3 where the cover has circular apertures to receive and pass the anchoring portion of the reinforcements.

10. The device as claimed in claim 2 wherein the cover elements have semicircular apertures in the edges thereof which adjoin each other, so that when the semicircular apertures are combined they form circular apertures to receive and pass the anchoring portions of the reinforcements.

11. The device as claimed in claim 1 wherein the cover has locking pins on its underside which can engage in corresponding holes in the anchoring strips.

12. The device as claimed in claim 7, wherein the blind slots are undercut in horizontal cross section and have expanded inner anchoring areas.

13. The device as claimed in claim 5, wherein the anchoring strips have narrow dividing slits therein.

14. The device as claimed in claim 1, wherein the depth of the slots is proportioned so that they can receive two or more connecting portions of the steel reinforcements lying one on top of the other.

15. The device as claimed in claim 1, wherein the slots are undercut in the vertical section.

16. The device as claimed in claim 14, wherein the slots are in the shape of a figure "8" in vertical section.

* * * * *